United States Patent [19]

Dills

[11] 4,455,467

[45] Jun. 19, 1984

[54] METAL RACK FOR MICROWAVE OVEN

[75] Inventor: Raymond L. Dills, Louisville, Ky.

[73] Assignee: General Electric Company, Louisville, Ky.

[21] Appl. No.: 304,278

[22] Filed: Sep. 21, 1981

[51] Int. Cl.[3] ..... H05B 9/06

[52] U.S. Cl. ..... 219/10.55 E; 219/10.55 F

[58] Field of Search ..... 219/10.55 E, 10.55 F, 219/10.55 R; 99/450; 108/156, 161

[56] References Cited

U.S. PATENT DOCUMENTS

| | | | |
|---|---|---|---|
| 1,248,150 | 11/1917 | Moody | 108/161 |
| 2,912,554 | 4/1959 | Snyder | 219/10.55 |
| 2,961,520 | 11/1960 | Long | 219/10.55 |
| 3,716,687 | 2/1973 | Constable | 219/10.55 B |
| 3,936,627 | 2/1976 | Fitzmayer | 219/10.55 |
| 4,074,102 | 2/1978 | Asen | 219/10.55 |
| 4,140,888 | 2/1979 | Baron et al. | 219/10.55 |
| 4,147,912 | 4/1979 | Uyeda | 219/10.55 M |
| 4,223,194 | 9/1980 | Fitzmayer | 219/10.55 |
| 4,249,464 | 2/1981 | Hansen | 219/10.55 E |

*Primary Examiner*—Roy N. Envall, Jr.
*Assistant Examiner*—M. M. Lateef
*Attorney, Agent, or Firm*—Frederick P. Weidner; Radford M. Reams

[57] ABSTRACT

A rack for use in a microwave oven cavity wherein the microwave energy enters the top of the cavity and the cavity has a rectangular shaped bottom shelf and sidewalls. The rack includes a metal rectangular framework of parallel bars and the framework is spaced inwardly of all sides of the cavity. The rack has legs depending from the corners of the framework and extending downwardly and diverging outwardly from the framework. Each of the legs has low loss dielectric insulating material on the terminal end thereof and the legs cooperate with the oven cavity bottom shelf and sidewalls such that the framework of the rack is centered relative to the cavity sidewalls and electrically insulated therefrom. With this rack two levels of food may be cooked simultaneously in the microwave oven.

7 Claims, 4 Drawing Figures

FIG. 1
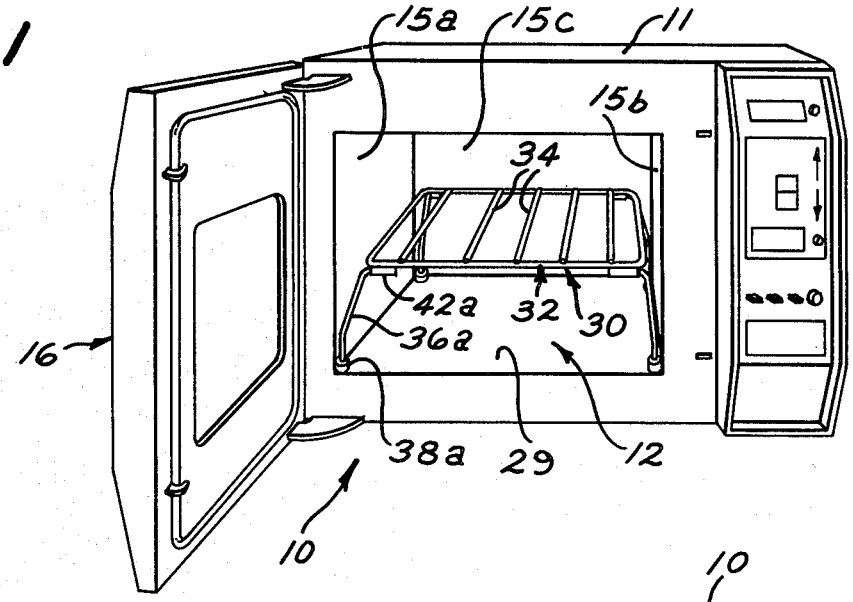
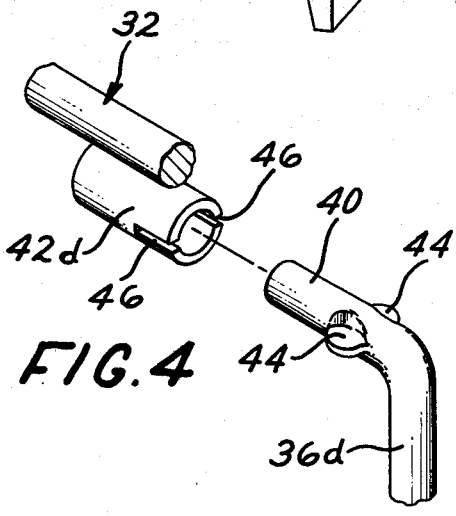
FIG. 4
FIG. 2
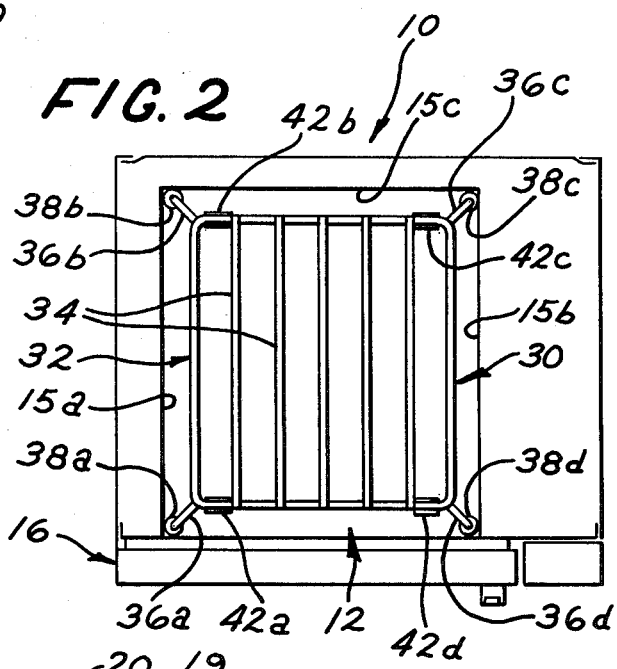
FIG. 3
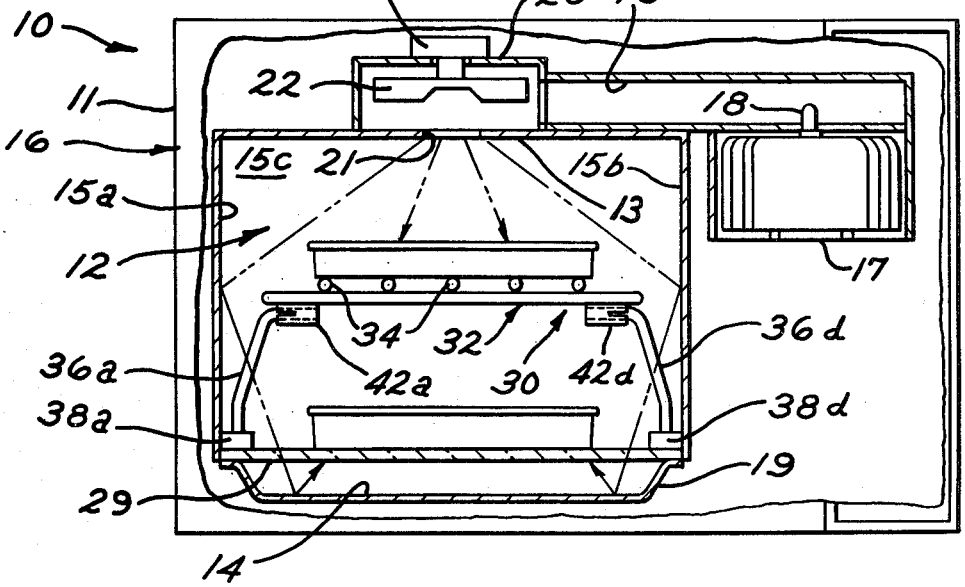

METAL RACK FOR MICROWAVE OVEN

BACKGROUND OF THE INVENTION

The present invention relates to a microwave cooking oven and specifically to a rack for use in the oven whereby two levels of food may be cooked simultaneously.

In a microwave oven cooking cavity, the spatial distribution of the microwave energy tends to be non-uniform. As a result, "hot spots" and "cold spots" are produced at different locations. For many types of foods, cooking results are unsatisfactory under such conditions because some portions of the food may be completely cooked while others are barely warmed. The problem becomes more severe with foods of low thermal conductivity which do not readily conduct heat from the areas which are heated by the microwave energy to those areas which are not. An example of a food falling within this class is cake. However, other foods frequently cooked in microwave ovens, such as meat, also produce unsatisfactory cooking results if the distribution of microwave energy within the oven cavity is not uniform.

One explanation for the non-uniform cooking pattern is that electromagnetic standing wave patterns, known as "modes," are set up within the cooking cavity. When a standing wave pattern is established, the intensities of the electric and magnetic fields vary greatly with position. The precise configuration of the standing wave or mode pattern is dependent at least upon the frequency of microwave energy used to excite the cavity and upon the dimensions of the cavity itself. It is possible to theoretically predict the particular mode patterns which may be present in the cavity, but actual experimental results are not always consistent with theory. This is particularly so in a countertop microwave oven operating at a frequency of 2450 MHz. Due to the relatively large number of theoretically possible modes within a given rectangular cavity, it is difficult to predict with certainty which of the modes will dominate. The situation is further complicated by the differing loading effects of different types and quantities of food which may be placed in the cooking cavity.

A number of different approaches to altering the standing wave patterns have been tried to an effort to alleviate the problem of non-uniform energy distribution. The most common approach is the use of a device known as a "mode stirrer," which typically resembles a fan having metal blades. The mode stirrer rotates and may be placed either within the cooking cavity itself (usually protected by a cover constructed of a material transparent to microwaves) or, to conserve space within the cooking cavity, it may be mounted within a recess formed in one of the cooking cavity walls, normally the top.

The function of the mode stirrer is to continually alter the mode pattern in the oven cavity. As a result of continually changing the mode pattern in the cavity, the "hot" and "cold" spots are continually shifted and, when averaged over a period of time, the energy distribution in the cavity is made more uniform.

The proper distribution of microwave energy, however, is particularly difficult where it is desired to cook two levels of food simultaneously. To do so a rack is needed to place one level of food above the other. These racks are normally made of plastic, however, it is desirable that the rack is made of metal. Normally metal racks used in a microwave oven detrimentally affects the distribution of the microwave energy. It is particularly difficult to arrange for two levels of food to be cooked with the same amount of microwave energy available to both levels. It is desirable to have such equal distribution of microwave energy as otherwise, one level would cook faster than the other and this, of course, is unsatisfactory.

By this invention, there is provided a rack for use in a microwave oven cavity which may be made of metal and does not detrimentally affect the microwave energy pattern in the cavity and does allow for the same amount of microwave energy available to both levels of food.

SUMMARY OF THE INVENTION

According to one aspect of this invention, there is provided a rack for use in a microwave oven cavity wherein the microwave energy enters the top of the cavity and the cavity has a rectangular shaped bottom shelf and sidewalls. The rack includes a metal rectangular framework of parallel bars and the framework is spaced inwardly of all sides of the cavity. The rack has legs depending from the corners of the framework and extending downwardly and diverging outwardly from the framework. Each of the legs has low loss dielectric insulating material on the terminal end thereof and the legs cooperate with the oven cavity bottom shelf and sidewalls such that the framework of the rack is centered relative to the cavity sidewalls and electrically insulated therefrom.

BRIEF DESCRIPTION OF THE DRAWINGS

FIG. 1 is a perspective view of a countertop microwave oven with the door open showing one form of the present invention located in the oven cavity.

FIG. 2 is a top view of a countertop microwave oven with parts removed to show the present invention located in the oven cavity.

FIG. 3 is a front schematic view of a countertop microwave oven showing the present invention located in the oven cavity.

FIG. 4 is a perspective view of a portion of the present invention.

DESCRIPTION OF THE PREFERRED EMBODIMENT

Referring to FIGS. 1 and 3, there is shown a microwave oven 10 comprising an outer casing 11 enclosing a cooking cavity 12 formed by top wall 13, bottom wall 14, and vertical sidewalls 15*a*–15*c* all of which are formed of sheet metal. The front of the cavity 12 is closed by door 16 (FIG. 1). A magnetron 17, powered by suitable control circuitry (not shown), generates microwave energy at a frequency of 2450 MHz having a wavelength in free space, $\lambda a$, of 4.82 inches which is coupled by a stub antenna 18 and waveguide 19 to a conventional feed box 20 mounted atop cavity 12 and from there through one or more openings 21 of the feed box 20 into the oven cavity 12. A mode stirrer 22, powered by motor 23, may be included within feed box 20 to vary the excitation modes within cooking cavity 12 as described above in connection with the background of the invention. Within cavity 12 there is provided a retangular shaped bottom shelf 29 made of low loss dielectric material which rests upon a peripheral ledge formed in the vertical sidewalls 15*a*–15*c* and also along the bottom lip of the front opening. The purpose of shelf 29 is to hold the food load in spaced relationship to the bottom 14 and thus place the food load in desirable position with respect to the excitation modes within cavity 12.

The microwave oven described above accommodates one level for cooking food; namely the shelf 29. It is often desirable to cook two levels of food simultaneously in the oven cavity 12 and to accomplish this there is provided a removable rack that may be placed in the oven cavity 12 and afford a second level of food to be cooked. Racks have been used heretofore, however, they are usually made of a plastic material so that they do not interfere with the microwave energy distribution within the cavity. By this invention I provide for a metal rack 30 which is sturdy and cleanable and which will not interfere with the microwave energy pattern within the cavity 12. The rack 30 includes a metal rectangular framework 32 made up of parallel metal bars 34 that are welded or otherwise joined to each other to form a rigid structure. The peripheral dimension of the framework 32 is such that the framework is spaced inwardly of all sides of the cavity 12 as can be readily seen in FIG. 2. The purpose of this, of course, is so that there is no metal to metal contact of the framework 32 with the sidewalls 15*a*–15*c* and the door 16. The exact spacing of the framework 32 from the sidewalls and door will be explained later. The rack 30 includes legs 36*a*–36*d* depending from the corners of the framework 32 which legs extend downwardly and diverge outwardly from the framework. The length of the legs is such that the rack when placed in the cavity 12 will position the framework 32 approximately midway between the top of the oven cavity and the shelf 29. The legs may be made of suitable low loss dielectric material or metal. A suitable low loss dielectric material, such as polysulfone plastic or ceramic material, would have a loss tangent of less than 0.004 at 2450 $MH_z$ and not be detrimentally affected by the heat of cooking. If the legs 36*a*–36*d* are made of metal, which is preferable, each of the metal legs 36*a*–36*d* depending from the corners of the framework has a low loss dielectric insulating material member on the terminal ends. In the preferred embodiment, there are ceramic insulator members 38*a*–38*d* on the respective terminal ends. The legs 36*a*–36*d* and insulator members 38*a*–38*d* cooperate with the oven cavity rectangular shaped bottom shelf 29 and sidewalls such that the framework 32 of the rack 30 is centered relative to the lateral cross section of the cavity 12 and with the ceramic insulators the rack is insulated electrically from the metal sidewalls 15*a*–15*c*, the door 16 and from the bottom shelf 29.

The rack 30 should have the framework 32 spaced from the cavity sidewalls 15*a*–15*c* and the door 16 a distance equal to $(N\lambda a)/2$ wherein N is an odd integer and $\lambda a$ is the microwave energy wavelength in free space. For instance, microwave energy at a frequency of 2450 MHz is a wavelength ($\lambda a$) of 4.82 inches thus solving the formula wherein the odd integer N is 1 the framework 32 should be spaced from the sidewalls 2.41 inches. Where the odd integer is 3 the framework would be spaced 7.23 inches from the sidewalls. With such spacing the microwave energy emanating from the openings 21 in cavity 12 (as shown by arrows in FIG. 3) may be reflected off the metal sidewalls 15*a*–15*c* and door 16 downwardly to the metal bottom wall 14 and then through the shelf 29 to the food to be cooked which is placed thereon. The height of the framework 32 from the shelf 29 and the spacing of the framework 32 from the sidewalls 15*a*–15*c* and door should be such that about fifty percent of the microwave energy entering through the openings 21 at the top of the cavity 12 will pass downwardly to the food load placed on the shelf 29. In this manner the two levels of food, one on the shelf 29, the other on the framework 32 of the rack 30 will be cooked with an equal share of the microwave energy available in the cavity 12. In the preferred embodiment the length of the metal bars 34 are approximately an odd multiple of $\lambda a/4$ so as to prevent resonances from occurring due to transmission modes between the metal bar 34 or between the bars and the bottom wall of the cavity 12. It will be noted that the preferred embodiment of the rack has a framework 32 comprised of seven parallel metal bars 34.

The legs 36*a*–36*d*, which, if made of metal, also carry the respective low loss dielectric material members 38*a*–38*d* may be collapsible, that is, either by folding or removing the legs so that the rack may be easily stored. FIG. 4 shows one suitable arrangement for the preferred embodiment having metal legs wherein each of the legs 36*a*–36*d* have a depending portion 40 insertable into sockets 42*a*–42*d* which are attached to the metal bars 34 of the framework 32. To provide the correct orientation of the legs 36*a*–36*d* with respect to the framework 32 lugs 44 may be formed in the depending portion 40 of each leg which lugs will be received in slots 46 in the sockets 42*a*–42*d*. It is important that the legs 36*a*–36*d* be oriented correctly with respect to the framework 32 so that when the rack is placed in the microwave oven cavity 12 the framework 32 is correctly spaced from the sidewalls 15*a*–15*c* and the door 16 to provide for the correct microwave energy distribution to the two different levels of food to be cooked. With this rack arrangement there is no need to provide shelf guideways on the sidewalls of the oven cavity which can be unsightly when not being used and they present a cleaning problem.

While, in accordance with the patent statutes, there has been described what at present is considered to be the preferred embodiment of the invention, it will be obvious to those skilled in the art that various changes and modifications may be made therein without departing from the invention. It is, therefore, intended by the appended claims to cover all such changes and modifications as fall within the true spirit and scope of the invention.

What is claimed is:

1. A microwave oven, comprising:

(a) an oven cavity having a top, a rectangular shaped bottom shelf and sidewalls;

(b) a microwave energy source;

(c) means to deliver microwave energy from the microwave energy source to the cavity through the top thereof; and (d) a rack including:

a metal, rectangular framework of parallel bars, said rack being spaced inwardly of all sides of the cavity, legs depending from the corners of the framework, said legs each having a terminal end and extending downwardly and diverging outwardly from the framework, said legs having low loss dielectric insulating material on the terminal ends thereof, the legs cooperating with the oven cavity bottom shelf and sidewalls such that the framework of the rack is centered relative to the cavity sidewalls and electrically insulated therefrom.

2. The microwave oven of claim 1 wherein the rack framework is spaced from the bottom shelf and all sides of the cavity so approximately half of the microwave energy is available to the food placed on the bottom shelf for cooking.

3. The microwave oven of claim 1 wherein the rack framework is spaced from the cavity sidewalls and a door a distance equal to $(N\lambda a)/2$ wherein N is an odd integer and $\lambda a$ is the microwave energy wavelength in free space.

4. The microwave oven of claim 1 wherein the legs of the rack are collapsible.

5. The microwave oven of claim 1 wherein the rack framework has seven parallel bars.

6. The microwave oven of claim 1 wherein the insulating material of the rack legs has a loss tangent of less then 0.004 at 2450 $MH_z$.

7. The microwave oven of claim 1 wherein the rack legs are metal with low loss dielectric insulating material members on the terminal ends thereof.

* * * * *